US010933669B2

(12) United States Patent
Kimura et al.

(10) Patent No.: US 10,933,669 B2
(45) Date of Patent: Mar. 2, 2021

(54) PRINT ELEMENT BOARD, LIQUID EJECTION HEAD, AND LIQUID EJECTION APPARATUS

(71) Applicant: CANON KABUSHIKI KAISHA, Tokyo (JP)

(72) Inventors: Satoshi Kimura, Kawasaki (JP); Shingo Okushima, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 16/305,024

(22) PCT Filed: May 25, 2017

(86) PCT No.: PCT/JP2017/019624

§ 371 (c)(1),
(2) Date: Nov. 27, 2018

(87) PCT Pub. No.: WO2017/208978

PCT Pub. Date: Dec. 7, 2017

(65) Prior Publication Data

US 2020/0316971 A1 Oct. 8, 2020

(30) Foreign Application Priority Data

May 30, 2016 (JP) ..... JP2016-107911

(51) Int. Cl.
*B41J 25/34* (2006.01)
*B41J 2/14* (2006.01)
(Continued)

(52) U.S. Cl.
CPC ..... *B41J 25/34* (2013.01); *B41J 2/14072* (2013.01); *B41J 2/0458* (2013.01); *B41J 2/155* (2013.01); *B41J 2202/20* (2013.01)

(58) Field of Classification Search
CPC ..... B41J 2/14072; B41J 2202/18; B41J 2002/14491
See application file for complete search history.

(56) References Cited

U.S. PATENT DOCUMENTS 7,407,262 B2 8/2008 Silverbrook
2015/0328894 A1 11/2015 Tamenaga
(Continued)

FOREIGN PATENT DOCUMENTS

CN 102256800 A 11/2011
CN 105307867 A * 2/2016 ..... B41J 2/14233
(Continued)

*Primary Examiner* — Julian D Huffman
(74) *Attorney, Agent, or Firm* — Canon U.S.A., Inc. IP Division

(57) ABSTRACT

A print element board includes a surface provided with a first side and a plurality of terminals arranged along the first side near the first side, in which an angle at a first peak located at a first end of the first side is smaller than an angle at a second peak located at a second end of the first side, and a printing element electrically connected with the terminals for recording. A distance between the first peak and a first terminal disposed closest to the first peak is longer than a distance between the second peak and a second terminal disposed closest to the second peak.

13 Claims, 7 Drawing Sheets

(51) Int. Cl.
*B41J 2/045* (2006.01)
*B41J 2/155* (2006.01)

(56) References Cited

U.S. PATENT DOCUMENTS

| | | | | |
|---|---|---|---|---|
| 2016/0144631 | A1 | 5/2016 | Takagi | |
| 2018/0304623 | A1* | 10/2018 | Okushima | B41J 2/1607 |
| 2018/0326725 | A1* | 11/2018 | Kasai | B41J 2/1601 |

FOREIGN PATENT DOCUMENTS

| | | | |
|---|---|---|---|
| EP | 2436521 | A1 | 4/2012 |
| JP | H10-202876 | A | 8/1998 |
| JP | 3552004 | B2 | 8/2004 |
| JP | 2015-174385 | A | 10/2015 |

* cited by examiner

[Fig. 1]
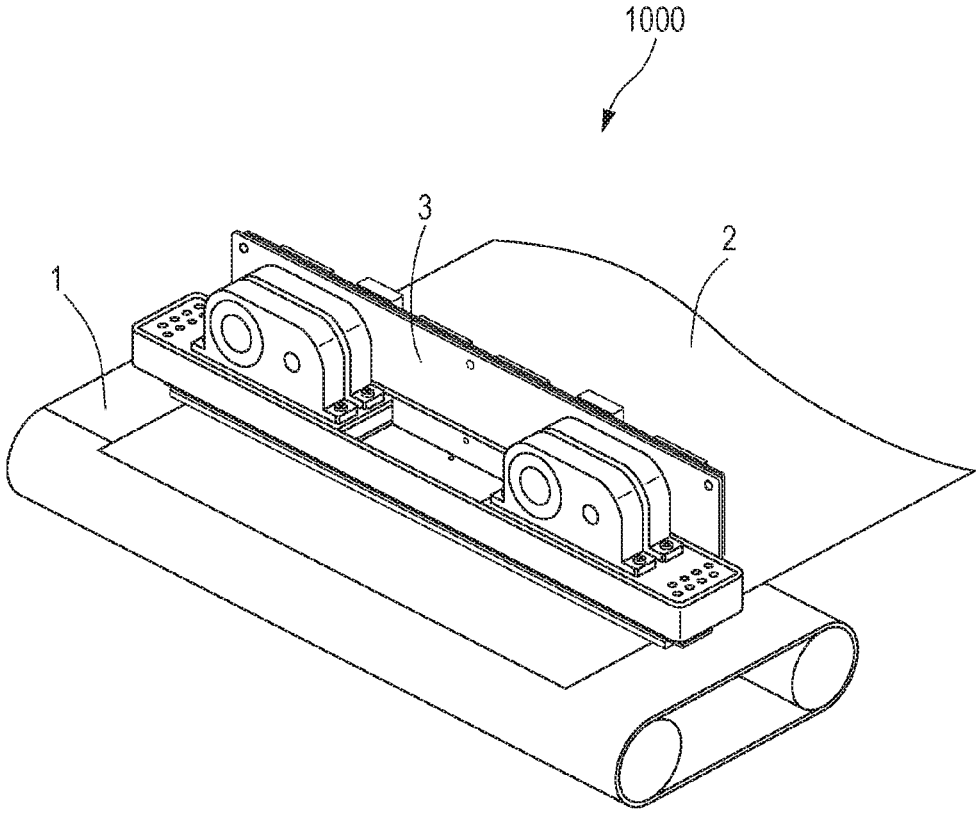

[Fig. 2A]
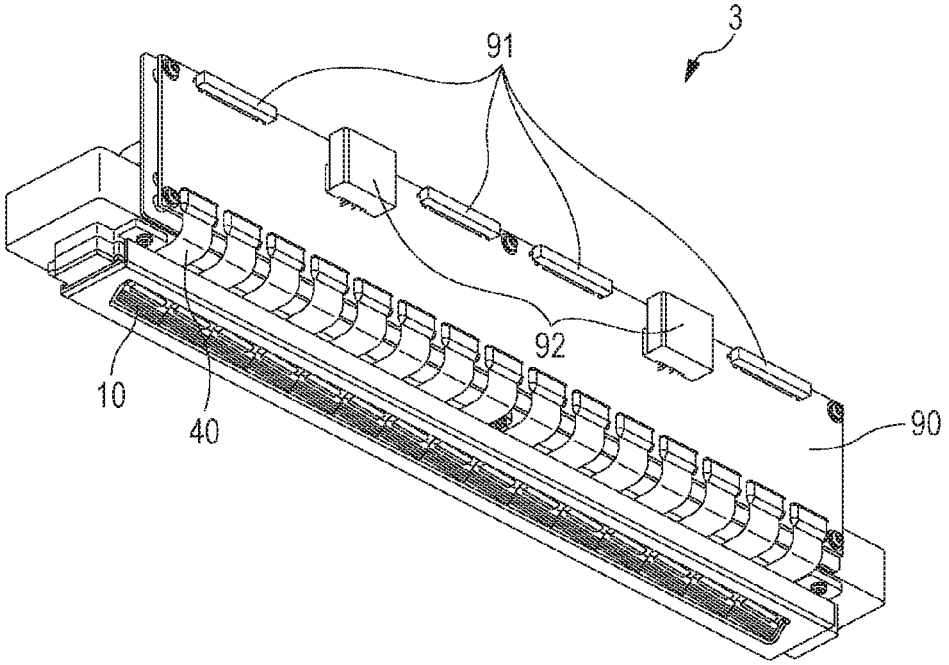
[Fig. 2B]
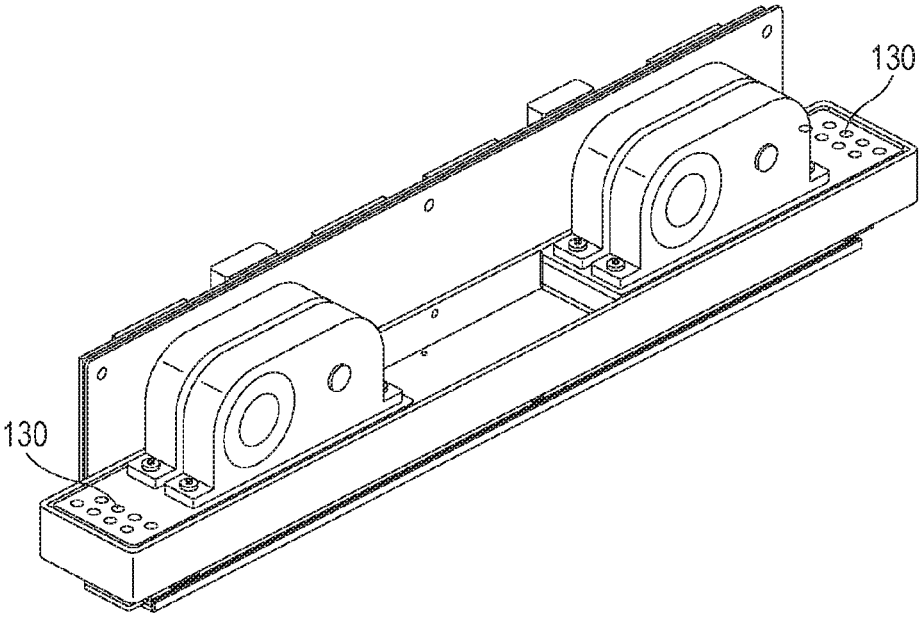

[Fig. 3A]
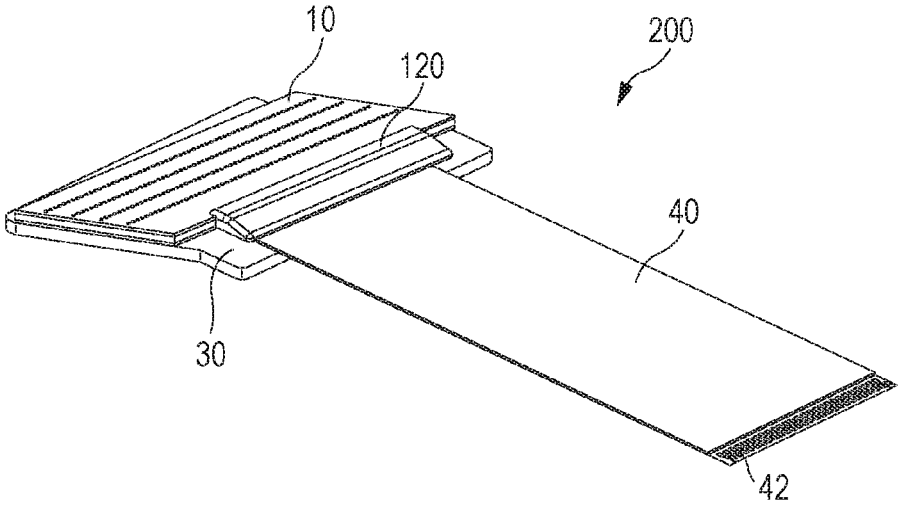
[Fig. 3B]
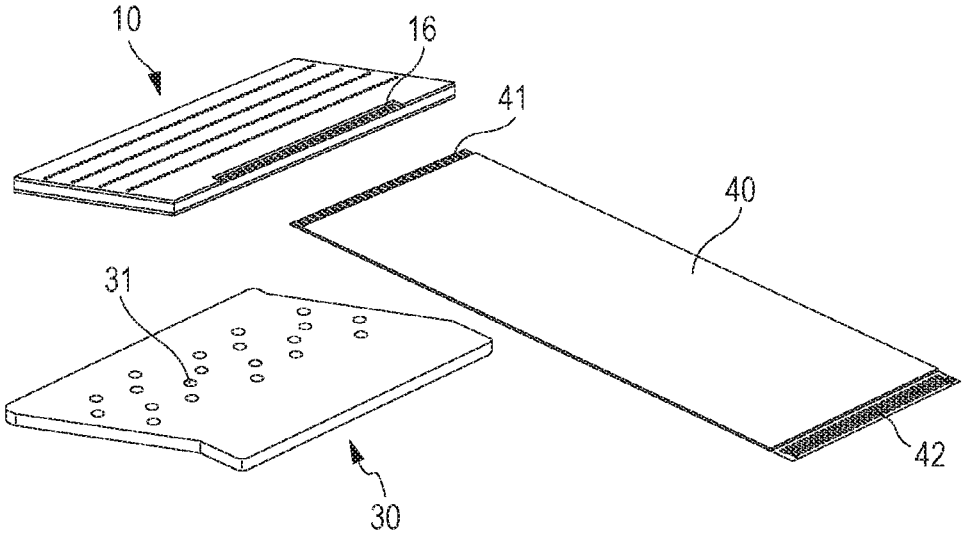

[Fig. 4]
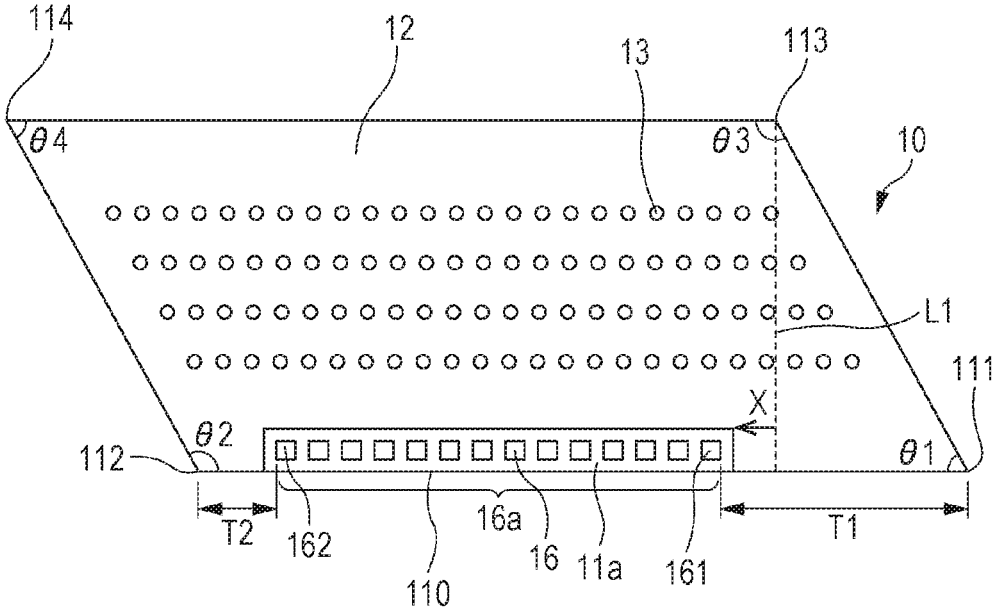

[Fig. 5]
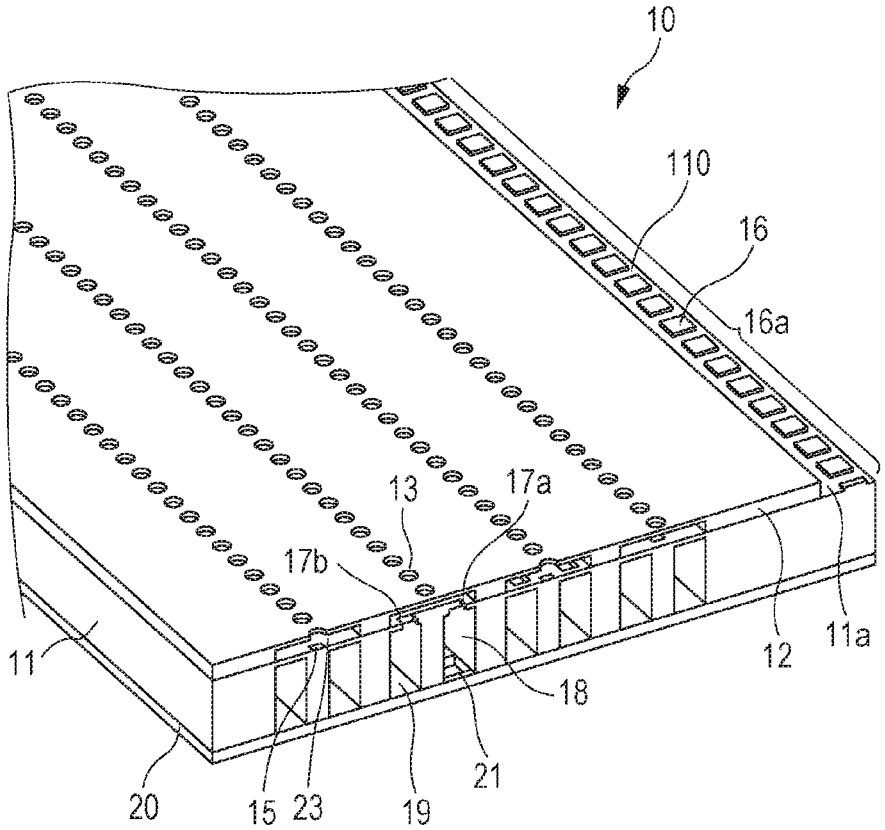

[Fig. 6A]
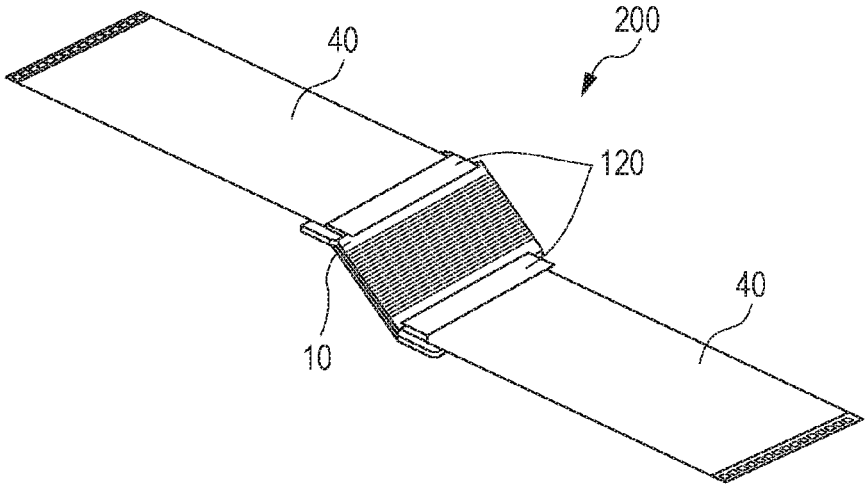
[Fig. 6B]
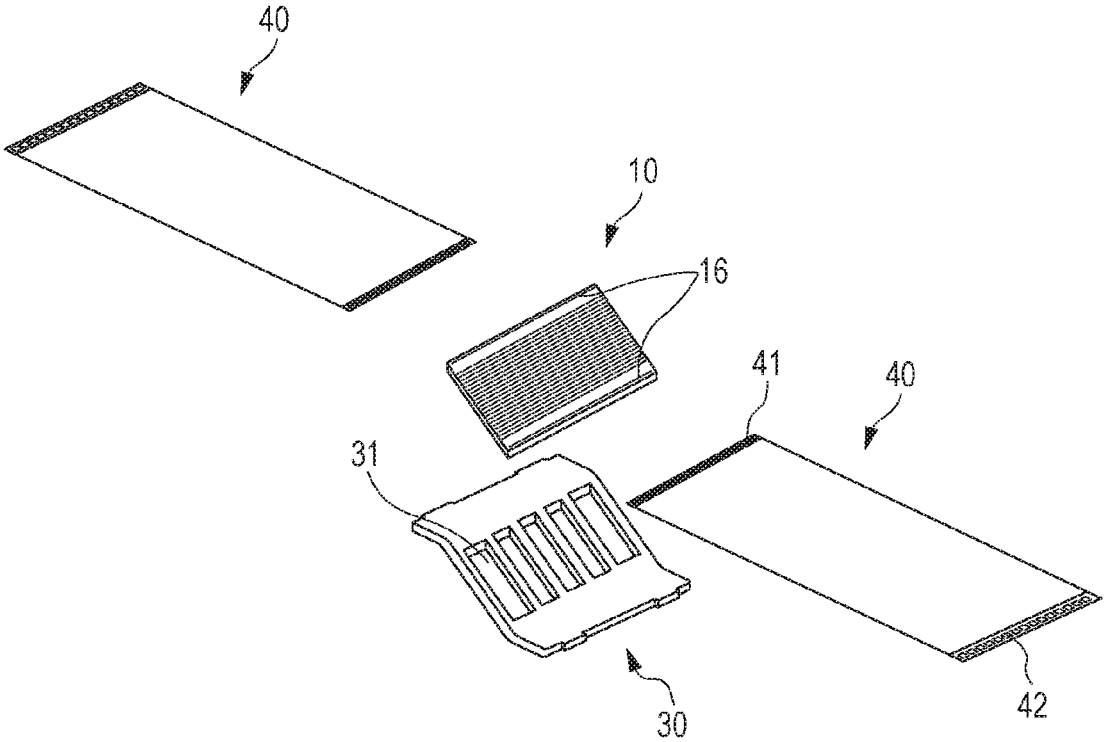

[Fig. 7]
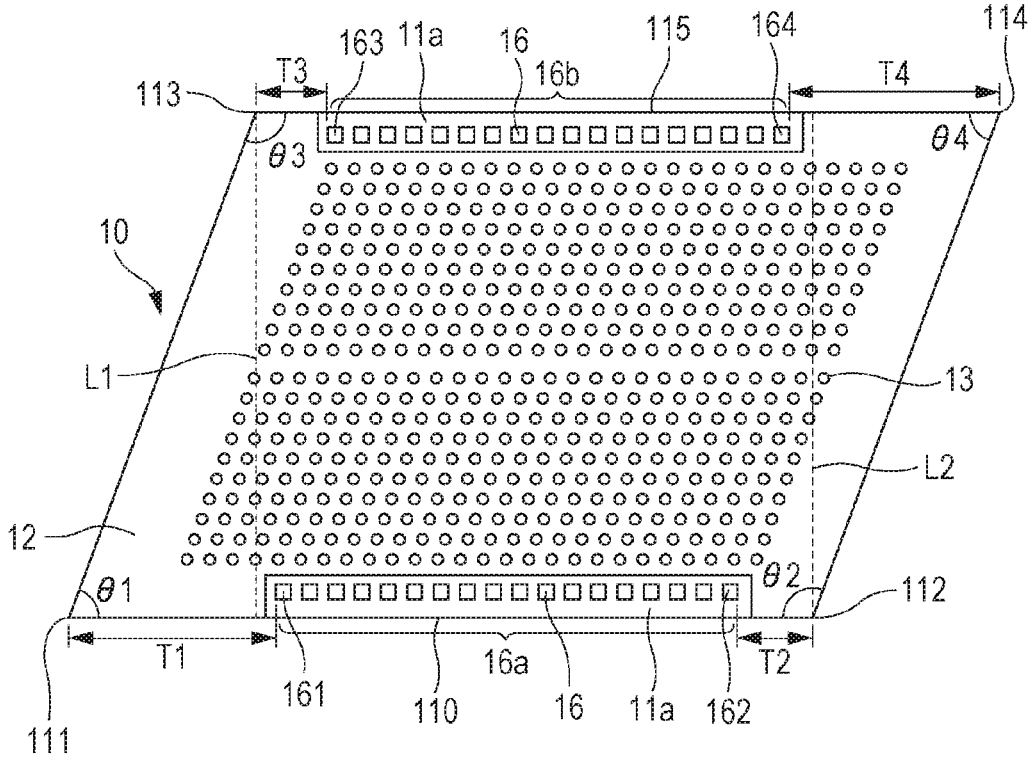

PRINT ELEMENT BOARD, LIQUID EJECTION HEAD, AND LIQUID EJECTION APPARATUS

TECHNICAL FIELD

The invention relates to a print element board for recording, a liquid ejection head provided with a print element board, and a liquid ejection apparatus.

BACKGROUND ART

A liquid ejection head includes a print element board provided with a printing element which generates energy for ejecting a liquid, and a wiring substrate for electrically connecting the print element board and a main body of the liquid ejection apparatus. The print element board includes a terminal and is electrically connected with the wiring substrate via the terminal. A printing element is driven based on a signal input from a control circuit of the main body of the liquid ejection apparatus via the wiring substrate, and a liquid is ejected, whereby an image is recorded. U.S. Pat. No. 7,407,262 discloses a configuration in which terminals are arranged along a side of a print element board.

Besides a print element board of which principal surface is rectangular in shape, a print element board of which principal surface is substantially parallelogrammatic in shape as described in Japanese Patent Laid-Open No. 2015-174385 is proposed.

CITATION LIST

Patent Literature

PTL 1: U.S. Pat. No. 7,407,262
PTL 2: Japanese Patent Laid-Open No. 2015-174385

SUMMARY OF INVENTION

Technical Problem

If an angle at a first end of a side which forms a surface is smaller than an angle at a second end of the side as in a print element board of which surface is substantially parallelogrammatic in shape, the following issue may arise. When cutting a wafer, conveying a print element board, assembling as a liquid ejection head, etc., chips and cracks may be produced with high possibility at a first end with a relatively smaller angle near a portion including the first end than a second end with a relatively larger angle. Therefore, if terminals are provided near a first end with a small angle, an electrical failure, such as disconnection of wires extending from these terminals, may be caused, and electric reliability of the print element board may be impaired. Especially if the angle is an acute angle, a possibility that chips and cracks may be produced near the angle is increased.

The invention reduces a decrease in electric reliability in a print element hoard in which an angle at a peak at a first end of a side which forms a surface of the print element board is smaller than an angle at a peak of a second end of the side.

Solution to Problem

A print element board of the invention includes a surface provided with a first side and a plurality of terminals arranged along the first side near the first side, in which an angle at a first peak located at a first end of the first side is smaller than an angle at a second peak located at a second end of the first side; and a printing element electrically connected with the plurality of terminals for recording, wherein a distance between the first peak and a first terminal disposed closest to the first peak among the plurality of terminals is longer than a distance between the second peak and a second terminal disposed closest to the second peak among the plurality of terminals.

Further features of the present invention will become apparent from the following description of exemplary embodiments with reference to the attached drawings.

BRIEF DESCRIPTION OF DRAWINGS

FIG. 1 is a schematic configuration diagram illustrating an inkjet recording apparatus.

FIG. 2A is a perspective view illustrating an inkjet recording head.

FIG. 2B is a perspective view illustrating an inkjet recording head.

FIG. 3A is a perspective view illustrating an ejection module of an inkjet recording head of a first embodiment.

FIG. 3B is a perspective view illustrating an ejection module of an inkjet recording head of a first embodiment.

FIG. 4 is a plan view illustrating a print element board of the first embodiment.

FIG. 5 is a perspective view illustrating a cross section in a direction perpendicularly crossing ejection port arrays of a print element board.

FIG. 6A is a perspective view illustrating an ejection module of an inkjet recording head of a second embodiment.

FIG. 6B is a perspective view illustrating an ejection module of an inkjet recording head of a second embodiment.

FIG. 7 is a plan view illustrating a print element board of the second embodiment.

DESCRIPTION OF EMBODIMENTS

Hereinafter, embodiments of the invention are described with reference to the drawings. It is to be understood that the following description is not limiting the scope of the invention. The embodiments of the invention employ a thermal process in which heating elements are used as recording elements, and air bubbles are generated to eject a liquid. However, a print element hoard employing a piezoelectric process or other various types of liquids ejecting processes may also be applied to the invention. The invention is applicable also to a print element board of an industrial recording apparatus for manufacturing biochip, printing electronic circuits, and resist coating for forming a circuit pattern of a semiconductor wafer, for example.

Although the present embodiment is a linear head having a length corresponding to a width of a recording medium, the invention is applicable also to a serial liquid ejection head which records on a recording medium while moving the head. An exemplary serial liquid ejection head includes both a print element board for black ink and a print element board for color ink.

Inkjet Recording Apparatus

As a liquid ejection apparatus to which the present embodiment is applicable, an inkjet recording apparatus 1000 (hereinafter, also referred to as a recording apparatus) which records by ejecting ink is described with reference to FIG. 1. FIG. 1 illustrates a schematic structure of the recording apparatus 1000. The recording apparatus 1000 includes a conveyance unit 1 which conveys a recording medium 2, and a linear liquid ejection head 3 disposed to substantially perpendicularly cross a conveying direction of the recording medium 2. The recording apparatus 1000 is a linear recording apparatus which continuously records on the recording medium 2 in one pass, while conveying a plurality of recording media 2 continuously or intermittently. The recording medium 2 is not limited to a cut sheet, but may be continuous rolled paper. The liquid ejection head 3 is capable of performing full color printing with cyan, magenta, yellow, and black (CMYK) ink. The liquid ejection head 3 is electrically connected with a control unit of the recording apparatus 1000 for transmitting power and ejection control signals to the liquid ejection head 3.

Liquid Ejecting Head

FIGS. 2A and 2B are perspective views of the liquid ejection head 3 according to the present embodiment. The liquid ejection head 3 is a linear liquid ejection head in which 15 print element boards 10 are arranged linearly in sequence (in-line). Each print element board 10 is capable of ejecting four (CMYK) colors of ink.

As illustrated in FIG. 2A, the liquid ejection head 3 includes the print element hoards 10, flexible wiring substrates 40, and an electric wiring board 90. The electric wiring hoard 90 includes signal input terminals 91 and power supply terminals 92. The signal input terminals 91 and the power supply terminals 92 are electrically connected with the control unit of the recording apparatus 1000, and ejection driving signals and power necessary for the ejection are supplied to the print element boards 10 via these terminals.

As illustrated in FIG. 2B, liquid connecting portions 130 provided at both ends of the liquid ejection head 3 are connected with a liquid supply system of the recording apparatus 1000. Therefore, ink of four (CMYK) colors is supplied to the liquid ejection head 3 from the supply system of the recording apparatus 1000, and ink passed inside of the liquid ejection head 3 is collected to the supply system of the recording apparatus 1000. Thus, ink of each color can be circulated through paths in the recording apparatus 1000 and paths in the liquid ejection head 3.

First Embodiment

Next, an ejection module 200 according to a first embodiment is described. FIG. 3A is a perspective view and FIG. 3B is an exploded view of the ejection module 200. The ejection module 200 includes a print element board 10, a flexible wiring substrate 40, and a support member 30 which supports the print element board 10 and the flexible wiring substrate 40. The print element board 10 and the flexible wiring substrate 40 are bonded on the support member 30. The support member 30 is a support which supports the print element board 10, and also is a flow path member capable of supplying a liquid to the print element hoard 10 via liquid communication ports 3L A plurality of ejection modules are arranged in the liquid ejection head 3 of the present embodiment.

Terminals 16 provided in the print element board 10 and terminals 41 provided in the flexible wiring substrate 40 are electrically connected by wire bonding. An electrical connection portion formed by these terminals 16 and 41 and wires is covered with a sealing member 120. Terminals 42 of the flexible wiring substrate 40 provided on the opposite side of the terminals 41 connected with the print element hoard 10 are electrically connected with connection terminals of the electric wiring board 90.

Next, a configuration of the print element hoard 10 in the present embodiment is described. FIG. 4 is a plan view of the print element board 10 seen from a side on which ejection ports 13 are provided. FIG. 5 is a perspective view illustrating a cross section in a direction perpendicularly crossing ejection port arrays of the print element board 10 of FIG. 4.

As illustrated in FIG. 5, the print element hoard 10 is constituted by a substrate 11 including a silicon substrate and an ejection port forming member 12 formed by photosensitive resin which are laminated. A lid member 20 is joined to a back side of the substrate 11. Four ejection port arrays in which the ejection ports 13 are arranged are provided in the ejection port forming member 12. Printing elements 15 are provided on a surface 11*a* of the substrate 11 which constitutes the print element board 10 corresponding to the ejection ports 13, and four recording element arrays are provided corresponding to the four ejection port arrays. Grooves for forming liquid supply paths 18 and liquid collection paths 19 extending along the ejection port arrays are provided on the back side of the substrate 11, and the liquid supply paths 18 and the liquid collection paths 19 are formed by the substrate 11 and the lid member 20.

A liquid (ink) which flows inside of the liquid supply paths 18 is supplied to pressure chambers 23 via supply ports 17*a*, generates energy used to eject the liquid by the printing element 15 when the printing element 15 is driven, whereby the supplied liquid is ejected. The liquid which flows inside of the liquid supply path 18 flows into the liquid collection paths 19 via the supply ports 17*a*, the pressure chambers 23, and collection ports 17*b*. With this liquid flow, thickened ink, air bubbles, foreign substance, etc. generated by evaporation from the ejection ports 13 can be collected to the liquid collection paths 19 in the ejection ports 13 and the pressure chambers 23 in which no ejection of the liquid is performed. Further, thickening of ink in the ejection ports 13 and the pressure chambers 23 may be prevented. The liquid collected to the liquid collection paths 19 passes openings 21 of the lid member 20 and liquid communication ports 31 (FIG. 3B) of the support member 30, and are collected to supply paths of the main body of the recording apparatus 1000 via the liquid connecting portions 130 (FIG. 2B). In the present embodiment, the liquid can be circulated between the pressure chambers 23 provided with the printing elements 15 thereinside and the main body of the recording apparatus 1000 which is outside of the pressure chambers 23.

The surface 11*a* of the print element board 10 includes, near a side 110, an electric connection area 16*a* in which a plurality of terminals 16 are arranged along the side 110. In the print element hoard 10, no ejection port forming member 12 is provided in the electric connection area 16*a* of the substrate 11. The terminals 16 are electrically connected with the printing elements 15 via wires provided in the substrate 11. The terminals 16 are connected with the terminals 41 of the flexible wiring substrate 40. The printing elements 15 provided in the print element board 10 and the control circuit provided in the main body of the recording apparatus 1000 are electrically connected via the flexible wiring substrate 40 and the electric wiring board 90. The printing elements 15 are driven based on a signal input from the control circuit, generate heat, and eject the liquid.

As illustrated in FIG. 4, the print element board 10 is substantially parallelogrammatic in shape when seen from a side on which the ejection ports 13 are provided. An angle θ1 at a first peak 111 at a first end of the side 110 which forms the surface 11*a* of the print element board 10 (the substrate 11) is less than 90°, and an angle θ2 at a second peak 112 at a second end of the side 110 is greater than 90°. An angle θ4 at a fourth peak 114 located diagonally across the first peak 111 is less than 90°, and an angle θ3 at a third peak 113 located diagonally across the second peak 112 is greater than 90°. That is, the angle including the first peak 111 and the angle including the fourth peak 114 are acute angles, and the angle including the second peak 112 and the angle including the third peak 113 are obtuse angles.

The shortest distance T1 between the first peak 111 and the electric connection area 16*a* is longer than the shortest distance T2 between the second peak 112 and the electric connection area 16*a*. The shortest distance T1 between the first peak 111 and the electric connection area 16*a* is also a distance between the first peak 111 and a first terminal 161 disposed closest to the first peak 111 among a plurality of terminals 16. The shortest distance 112 between the second peak 112 and the electric connection area 16*a* is also a distance between the second peak 112 and a second terminal 162 disposed closest to the second peak 112 among a plurality of terminals 16. As described above, if a side has different inner angles at the first end and the second end, the distance between the first end at which the inner angle is relatively smaller and the electric connection area 16*a* is set to be longer than a distance between the second end at which the inner angle is relatively larger and the electric connection area 16*a*.

Therefore, a distance from the first peak 111 which is the side of both ends of the side 110 on which chips tend to be produced to the electric connection area 16*a* can be kept unused. Since it is unnecessary to dispose the terminals 16 and wires extending from the terminals 16 near the first peak 111, even if chips and cracks are produced in the print element board 10 at the first peak 111 or near the first peak 111, a possibility of occurrence of disconnection of the wires extending from the terminals 16 can be reduced. Therefore, a decrease in electrical reliability of the print element board 10 can be prevented.

If the number of the terminals 16 is large and the length of the ejection port arrays in the electric connection area 16*a* is long, the shortest distance between the first peak 111 and the electric connection area 16*a* and the shortest distance between the second peak 112 and the electric connection area 16*a* of the print element board 10 become shorter. Especially in this case, it is effective to set the shortest distance T1 between the first peak 111 and the electric connection area 16*a* to be longer than the shortest distance T2 between the second peak 112 and the electric connection area 16*b* as described above.

The electric connection area 16*a* is desirably provided nearer to the second peak 112 than an imaginary line L1 which passes the third peak 113 located diagonally across the second peak 112 and perpendicularly crosses the side 110. That is, the first terminal 161 disposed closest to the first peak 111 is desirably provided nearer to an arrow X than the imaginary line L1. Therefore, since the first peak 111 and the electric connection area 16*a* can be separated from each other, electric reliability can be further increased.

Although the surface 11*a* of the print element board 10 (the substrate 11) is parallelogrammatic in shape in the present embodiment, the invention is not limited to the same. An angle at the peak at the first end of the side which forms the surface 11*a* of the print element board 10 may desirably be smaller than an angle at the peak at the second end of the side. The invention is applicable also to a case where a print element board of trapezoid and polygon in shape is employed, for example.

Second Embodiment

Next, an ejection module 200 according to a second embodiment is described. FIG. 6A is a perspective view and FIG. 6B is an exploded view of the ejection module 200. In the present embodiment, a plurality of terminals 16 are disposed at both sides along ejection port arrays of a print element hoard 10 (each long side of the print element board 10), and two flexible wiring substrates 40 which are electrically connected with the terminals 16 are provided with respect to a single print element board 10. This is because twenty ejection port arrays, which are significantly greater in number than those of the first embodiment, are provided in the print element board 10. That is, an object of the present embodiment if to control the longest distance from the terminals 16 to printing elements 15 provided corresponding to the ejection port arrays to be short, whereby a voltage drop caused in a wiring portion and signal transmission delay in the print element board 10 is to be reduced.

Next, a configuration of the print element board 10 in the present embodiment is described. FIG. 7 is a plan view of the print element board 10 seen from a side on which ejection ports 13 are provided. Twenty ejection port arrays are formed in the ejection port forming member 12 of the print element board 10. As in the embodiment described above, the print element board 10 is substantially parallelogrammatic in shape when seen from a side on which the ejection ports 13 are provided. An angle θ1 at a first peak 111 at a first end of the side 110 which forms the surface 11*a* of the print element board 10 (the substrate 11) is less than 90°, and an angle θ2 at a second peak 112 at a second end of the side 110 is greater than 90°. An angle θ4 at a fourth peak 114 located diagonally across the first peak 111 is less than 90°, and an angle θ3 at a third peak 113 located diagonally across the second peak 112 is greater than 90°.

In the present embodiment, as described above, a surface 11*a* of the print element hoard 10 also has an electric connection area 16*b* in which a plurality of terminals 16 are arranged along a side 115 near the side 115 opposite to the side 110 besides an electric connection area 16*a* provided near the side 110. The shortest distance T1 between the first peak ill and the electric connection area 16*a* is longer than the shortest distance T2 between the second peak 112 and the electric connection area 16*a*. The shortest distance T4 between a fourth peak 114 and the electric connection area 16*b* is longer than the shortest distance T3 between a third peak 113 and the electric connection area 16*b*. The shortest distance T1 is also a distance between the first peak 111 and a first terminal 161 disposed closest to the first peak 111 among a plurality of terminals 16 disposed in the electric connection area 16*a*. The shortest distance T2 is also a distance between the second peak 112 and a second terminal 16:2 disposed closest to the second peak 112 among a plurality of terminals 16 disposed in the electric connection area 16*a*. The shortest distance T3 is also a distance between the third peak 113 and a third terminal 163 disposed closest to the third peak 113 among a plurality of terminals 16 disposed in the another electric connection area 16*b*. The shortest distance T4 is also a distance between the fourth peak 114 and a fourth terminal 164 disposed closest to the fourth peak 114 among a plurality of terminals 16 disposed in the another electric connection area 16*b*.

Therefore, a distance from the first peak 111 which is the side of both ends of the side 110 on which chips tend to be produced to the electric connection area 16*a* can be provided, and a distance from the fourth peak 114 which is the side of both ends of the side 115 on which chips tend to be produced to the electric connection area 16*b* can be kept unused. Therefore, it is unnecessary to dispose the terminals 16 and wires extending from the terminals 16 near the first peak 111 and the fourth peak 114. Even if chips and cracks are produced in the print element board 10 at the first peak 111 or near the first peak 111, at the fourth peak 114 or near the fourth peak 114, a possibility of occurrence of disconnection of the wires extending from the terminals 16 can be reduced. Therefore, a decrease in electrical reliability of the print element board 10 can be prevented.

Further, as in the embodiment described above, the electric connection area 16*a* is desirably provided nearer to the second peak 112 than an imaginary line L1 which passes the third peak 113 located diagonally across the second peak 112 and perpendicularly crosses the side 110. That is, the first terminal 161 disposed closest to the first peak 111 is desirably provided nearer to the second peak 112 than the imaginary line L1. Similarly, the electric connection area 16*b* is desirably provided nearer to the third peak 113 than an imaginary line L2 which passes the second peak 112 located diagonally across the third peak 113 and perpendicularly crosses the side 115. That is, the fourth terminal 164 disposed closest to the fourth peak 114 is desirably provided nearer to the third peak 113 than the imaginary line L2. Therefore, since the first peak 111 and the electric connection area 16*a* can be separated from each other, and the fourth peak 114 and the electric connection area 16*b* can be separated from each other, electric reliability can be further increased.

If a plurality of electric connection areas 16 are provided, in at least one of the electric connection areas 16, a distance between a first end at which an inner angle is relatively smaller and the electric connection area 16 may desirably be set to be longer than a distance between a second end at which an inner angle is relatively larger and the electric connection area 16.

As illustrated in FIG. 6A, in the ejection module 200, the terminals 16 are electrically connected with terminals 41 provided in the flexible wiring substrates 40, and are covered with sealing members 120. The print element board 10 is affected by cure shrinkage or thermal expansion of the sealing members 120. As in the present embodiment, since the sealing members 120 are disposed at opposite sides 110 and 115 of the print element board 10, an influence of positional misalignment caused by cure shrinkage and thermal expansion of the sealing member 120 is offset and reduced.

If the print element board 10 is substantially parallelogrammatic in shape, since a bonding area between the print element board 10 and a support member 30 in a direction perpendicularly crossing the side 110 is smaller than other areas near the first peak 111 which is an acute angle side, bonding strength between the print element board 10 and the support member 30 is low. The same applies to an area near the fourth peak 114. Therefore, even if the sealing members 120 are disposed at opposite sides 110 and 115, if the sealing members 120 are disposed at the areas near the first peak 111 and the fourth peak 114, positional misalignment may be caused in a direction in which the print element board 10 is rotated with force by contraction and expansion of the sealing members 120.

In the present embodiment as described above, the shortest distance T1 between the first peak 111 and the electric connection area 16*a* is longer than the shortest distance T2 between the second peak 112 and the electric connection area 16*a*. Further, the shortest distance T4 between the fourth peak 114 and the electric connection area 16*b* is longer than the shortest distance T3 between the third peak 113 and the electric connection area 16*b*. Accordingly, the shortest distance between the first peak 111 and the sealing member 120 which covers the electric connection area 16*a* is longer than the shortest distance between the second peak 112 and the sealing member 120 which covers the electric connection area 16*a*. Further, the shortest distance between the fourth peak 114 and the sealing member 120 which covers the electric connection area 16*b* is longer than the shortest distance between the third peak 113 and the sealing member 120 which covers the electric connection area 16*b*. Therefore, since the first peak 111 and the sealing member 120 can be separated from each other, and the fourth peak 114 and the sealing member 120 can be separated from each other, occurrence of positional misalignment of the print element board 10 caused by contraction and expansion of the sealing members 120 can be prevented.

The electric connection area 16*a* and the sealing member 120 covering the electric connection area 16*a* may desirably be disposed nearer to the second peak 112 than the imaginary line L1, and the electric connection area 16*b* and the sealing member 120 covering the electric connection area 16*b* may desirably be provided nearer to the third peak 113 than the imaginary line L2. Therefore, an area to be affected by contraction and expansion of the sealing members 120 is limited to a rectangular area constituted by the side 110, the side 115, the imaginary line L1, and the imaginary line L2 of the print element board 10.

It is more desirable that the shortest distance T1 and the shortest distance T4 are equal to each other, and the shortest distance T2 and the shortest distance T3 are equal to each other. That is, it is more desirable that the electric connection area 16*a* and the electric connection area 16*b* are disposed point-symmetric about the center of gravity of the surface 11*a* of the mint element board 10. Therefore, since the sealing members 120 can be disposed substantially symmetrically on the side 110 and on the side 115, the same influence due to contraction and expansion of the sealing members 120 may be applied to the side 110 and the side 110, whereby occurrence of positional misalignment of the print element board 10 can be further prevented. As described above, according to the invention, electric reliability in a print element board in which an angle at a peak at a first end of a side which forms a surface of the print element board is smaller than an angle at a peak of a second end of the side can be decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-107911, filed May 30, 2016, which is hereby incorporated by reference herein in its entirety.

REFERENCE SIGNS LIST

10 Print element board
11 Substrate
15 Printing element
16 Terminal
16*a* Electric connection area

The invention claimed is:

1. A print element board comprising:

a surface provided with a first side and a plurality of terminals arranged along the first side near the first side, in which an angle at a first peak located at a first end of the first side is smaller than an angle at a second peak located at a second end of the first side; and a printing element electrically connected with the plurality of terminals for recording, wherein a distance between the first peak and a first terminal disposed closest to the first peak among the plurality of terminals is longer than a distance between the second peak and a second terminal disposed closest to the second peak among the plurality of terminals.

2. The print element board according to claim 1, wherein the angle at the first peak is less than 90°.

3. The print element board according to claim 2, wherein the angle at the second peak is greater than 90°.

4. The print element board according to claim 1, wherein the surface is parallelogrammatic in shape.

5. The print element board according to claim 4, wherein the first terminal is disposed nearer to the second peak than an imaginary line which passes a third peak located diagonally across the second peak of the surface and perpendicularly crosses the first side.

6. The print element board according to claim 4, wherein the surface includes a plurality of the other terminals arranged along a second side near the second side opposite to the first side, the other terminals being different from the terminals, a third peak located diagonally across the second peak, and a fourth peak located diagonally across the first peak, and a distance between the fourth peak and a fourth terminal disposed closest to the fourth peak among the plurality of the other terminals is longer than a distance between the third peak and a third terminal disposed closest to the third peak among the plurality of the other terminals.

7. The print element board according to claim 6, wherein an area in which the plurality of terminals are arranged and an area in which the plurality of the other terminals are arranged are disposed point-symmetric about the center of gravity of the surface.

8. A liquid ejection head comprising:

the print element board according to claim 6, a first wiring substrate provided with first wiring electrically connected with the plurality of terminals, and a second wiring substrate provided with second wiring electrically connected with the other terminals.

9. The liquid ejection head according to claim 8, further comprising a sealing member configured to cover the plurality of terminals, and a sealing member configured to cover the plurality of the other terminals.

10. A liquid ejection head, comprising:

the print element board according to claim 1, and a wiring substrate provided with wires electrically connected with the plurality of terminals.

11. The liquid ejection head according to claim 10, wherein the plurality of terminals and the wires are electrically connected by wire bonding.

12. The liquid ejection head according to claim 10, wherein the print element board includes a pressure chamber provided with the printing element thereinside, the printing element generates energy used to eject a liquid, and the liquid in the pressure chamber is circulated between the pressure chamber and outside of the pressure chamber.

13. A liquid ejection apparatus configured to eject a liquid using the liquid ejection head according to claim 10.

* * * * *